US005493867A

United States Patent [19]

Szynal et al.

[11] Patent Number: 5,493,867

[45] Date of Patent: Feb. 27, 1996

[54] FUZZY LOGIC ADAPTIVE DEFROST CONTROL

[75] Inventors: Joseph M. Szynal, Laporte, Ind.; Beth A. Maddix, Lincoln Township, Berrien County, Mich.; Ronald W. Guess, Evansville, Ind.

[73] Assignee: Whirlpool Corporation, Benton Harbor, Mich.

[21] Appl. No.: 258,893

[22] Filed: Jun. 13, 1994

Related U.S. Application Data

[63] Continuation-in-part of Ser. No. 978,275, Nov. 18, 1992, Pat. No. 5,363,669.

[51] Int. Cl.[6] ..... F25D 21/00

[52] U.S. Cl. ..... 62/80; 62/155; 62/234

[58] Field of Search ..... 62/155, 151, 234, 62/156, 154, 80, 140, 128

[56] References Cited

U.S. PATENT DOCUMENTS

| | | | |
|---|---|---|---|
| 4,156,350 | 5/1979 | Elliott et al. | 62/80 |
| 4,251,988 | 2/1981 | Allard et al. | 62/80 |
| 4,297,852 | 11/1981 | Brooks | 62/153 |
| 4,299,095 | 11/1981 | Cassarino | 62/155 |
| 4,407,138 | 10/1983 | Mueller | 62/126 |
| 4,573,326 | 3/1986 | Sulfstede et al. | 62/156 |
| 4,615,179 | 10/1986 | Chiu et al. | 62/129 |
| 4,694,657 | 9/1987 | Vaughn | 62/80 |
| 4,750,332 | 6/1988 | Jenski et al. | 62/80 |
| 4,850,204 | 7/1989 | Bos et al. | 62/234 |
| 4,884,414 | 12/1989 | Bos | 62/156 |
| 4,938,027 | 7/1990 | Midland | 62/80 |
| 5,148,977 | 9/1992 | Hibino et al. | 236/49.3 |
| 5,179,841 | 1/1993 | Phillips et al. | 62/81 |
| 5,261,247 | 11/1993 | Knezic et al. | 62/117 |

*Primary Examiner*—Harry B. Tanner

*Attorney, Agent, or Firm*—Stephen D. Krefman; Joel M. Van Winkle

[57] ABSTRACT

A defrost cycle controller for modifying the total length of time a compressor operates before a defrost cycle is initiated, wherein the time the compressor is on between defrost cycles is referred to herein as a frost accumulation period. A microprocessor includes means for deenergizing the compressor and coupling the defrost heater to a power supply when a continuous compressor run time exceeds a predetermined demand defrost time. The microprocessor further includes means for determining the time required to actually defrost the evaporator during a defrost operation, referred to herein as a defrost time, and means for modifying the frost accumulation period in response to the time to complete the defrost operation. The present invention further provides a method for determining the time required to actually defrost the evaporator during a first defrost operation, referred to herein as a first defrost time, and for determining the time required to actually defrost the unit during a second defrost operation, referred to herein as a second defrost time, wherein the second defrost operation is immediately subsequent to the first defrost operation. An inference is made as to whether the frost accumulating period should be modified before initiating the next defrost operation in response to the first defrost time and the second defrost time are provided and the frost accumulating period is modified if required.

12 Claims, 7 Drawing Sheets

INITIALIZE
100
COMP. ON?
102
NO
YES
COUNT CCT
104
SUM FOR CT
106
CT ≧ TCT?
108
NO
YES

COMP. OFF
110
ENERGIZE DEFROST HEATER
112
COUNT DT UNTIL EOD
114
STORE DT TO RAM
116
APPLY FUZZY LOGIC TO DT AND PDT TO MODIFY TCT
118
DRIP TIME
120
DEENERGIZE RELAY
122
CT ≧ MINCT?
130
NO
YES
CCT ≧ ODT?
132
NO
YES
COMP. OFF
134
ENERGIZE DEFROST HEATER
136
COUNT DT UNTIL EOD
138
APPLY FUZZY LOGIC TO OT TO MODIFY TCT
140
DRIP TIME
142
DEENERGIZE RELAY
144

RULE 1: IF(CURRENT DEFROST TIME) AND (PREVIOUS DEFROST TIME) THEN (CHANGE IN COMPRESSOR RUN TIME).

CURRENT DEFROST TIME (MINUTES)

| PREVIOUS DEFROST TIME (MIN.) | NXB | NB | NS | Z | PS | PB |
|---|---|---|---|---|---|---|
| NXB | RES | PB | PS | Z | NS | NB |
| NB | NB | PB | PB | PS | Z | NS |
| NS | Z | PB | PS | Z | NS | NB |
| Z | Z | PS | PS | Z | NS | NB |
| PS | Z | PS | PS | Z | NS | NB |
| PB | Z | PS | PS | Z | NS | NB |

FUZZY ADAPTIVE DEFROST CONTROL ALGORITHM

| DEFROST TIME | NXB | NB | NS | Z | PS | PB |
|---|---|---|---|---|---|---|
| CHANGE IN COMPR. TIME | RESET | Z | Z | NS | NB | RESET |

ADAPTIVE DEFROST FUZZY ALGORITHM
LOOKUP TABLE

| DEFROST LENGTH | 13 MIN. TARGET | 17 MIN. TARGET |
|---|---|---|
| 0 | RESET | RESET |
| 1 | RESET | RESET |
| 2 | RESET | RESET |
| 3 | RESET | RESET |
| 4 | RESET | RESET |
| 5 | RESET | RESET |
| 6 | NO CHANGE | RESET |
| 7 | NO CHANGE | RESET |
| 8 | NO CHANGE | RESET |
| 9 | NO CHANGE | RESET |
| 10 | NO CHANGE | NO CHANGE |
| 11 | NO CHANGE | NO CHANGE |
| 12 | REDUCE 3 HOURS | NO CHANGE |
| 13 | REDUCE 3 HOURS | NO CHANGE |
| 14 | REDUCE 3 HOURS | NO CHANGE |
| 15 | RESET | NO CHANGE |
| 16 | RESET | REDUCE 3 HOURS |
| 17 | RESET | REDUCE 5 HOURS |
| 18 | RESET | REDUCE 9 HOURS |
| 19 | RESET | RESET |
| 20 | RESET | RESET |
| 21 | RESET | RESET |
| 22 | N/A | RESET |
| 23 | N/A | RESET |
| 24 | N/A | RESET |
| 25 | N/A | RESET |

FIG. 11

FUZZY LOGIC ADAPTIVE DEFROST CONTROL

This application is a continuation-in-part of application Ser. No. 07/978,275, filed Nov. 18, 1992, U.S. Pat. No. 5,363,669.

BACKGROUND OF THE INVENTION

The present invention generally relates to refrigeration devices. More particularly, the present invention relates to defrost cycle controllers for refrigerators and freezers.

As is known, refrigerator and freezer systems, especially of the home appliance type, provide cooled air to an enclosure in which food and the like can be stored, thereby to prolong the edible life of the food. The enclosures, namely refrigerators and freezers, are cooled by air blown over heat exchangers, the heat exchangers extracting heat from the air thereby producing cooled air. The heat exchangers generally operate on the known cooling effect provided by gas that is expanded in a closed circuit, i.e., the refrigeration cycle. However, to be expanded, the gas must also be compressed and this is accomplished by the use of a compressor.

The efficiency of the systems can be enhanced by reducing the amount of frost that builds up on the heat exchanger, as is known. Modern systems are generally of the self-defrosting type. To this end, they employ a heater specially positioned and controlled to slightly heat the enclosure to cause melting of frost build-up on the heat exchanger. These defrost heaters are controlled pursuant to defrost cycle algorithms and configurations.

As a result, these freezers-refrigerators undergo two general cycles or modes, a cooling cycle or mode and a defrost cycle or mode. During the cooling cycle, a compressor is connected to a line voltage and the compressor is cycled on and off by means of a thermostat, i.e., the compressor is actually run only when the enclosure becomes sufficiently warm. During the defrost cycle, the compressor is disconnected from the line voltage and instead, a defrost heater is connected to the line voltage. The defrost heater is turned off by means of a temperature sensitive switch, after the frost has been melted away.

Generally, there are three known ways or techniques for controlling the operation of such a compressor and such a defrost heater with what is referred to herein as a defrost cycle controller. These three ways are referred to herein as real or straight time, cumulative time, and variable time.

The real time technique involves monitoring the connection of the system to line voltage. The interval between defrosts is then based on a fixed interval of real time.

The cumulative time method involves monitoring of the cumulative time a compressor is run during a cooling interval. The interval between defrost cycles is then varied based on the cumulative time the compressor is run.

The variable time method is the most recently adopted method and involves allowing for variable intervals between defrost cycles by monitoring both cumulative compressor run time as well as continuous compressor run time, and defrost length. The interval between defrost cycles then is based more closely on the need for defrosting.

As is known, during a defrost cycle there is also dripping of melted frost to a drip pan from which the melted frost evaporates. This is known as the drip mode or cycle and those terms are used herein.

Among others, the United States government has continuously enacted more and more stringent laws and regulations relating to the efficiency of refrigerators and freezers, particularly as home appliances. As a result, much research has been directed to more effective control over the refrigeration cycles of refrigerators and freezers and, particularly, to the defrost cycle, since in this cycle, the effect of refrigeration is, on the one hand, counteracted by removing cold from the enclosure, and on the other hand, enhanced by increasing the efficiency of refrigeration by removing insulating frost.

Patents directed to defrost controllers include:

| | |
|---|---|
| U.S. Pat. No. 4,156,350 | Refrigeration Apparatus Demand Defrost Control System and Method |
| U.S. Pat. No. 4,411,139 | Defrost Control System and Display Panel |
| U.S. Pat. No. 4,850,204 | Adaptive Defrost System with Ambient Condition Change Detector |
| U.S. Pat. No. 4,884,414 | Adaptive Defrost System |
| U.S. Pat. No. 4,251,988 | Defrosting System Using Actual Defrosting Time as a Controlling Parameter |

The teachings of these patents are incorporated herein by reference.

SUMMARY OF THE INVENTION

The present application provides one or more inventions directed to improvements in refrigeration/freezer defrost cycle controllers. These improvements can be provided in a single all-encompassing unit or practiced separately.

According to the present invention, there is provided a defrost cycle controller for modifying the total length of time a compressor operates before a defrost cycle is initiated, wherein the time the compressor is on between defrost cycles is referred to herein as a frost accumulation period. The defrost cycle controller includes a relay operatively connected to mutually exclusively couple the compressor and a defrost heater to a power supply. A first signal line provides a first signal indicative of the operating status of the compressor while a second signal line provides a second signal indicative of the defrost heater. A microprocessor is operatively coupled to the first and second signal lines and to the relay to control energization of the relay and to selectively couple the compressor and said defrost heater to the power supply. The microprocessor includes means for deenergizing the compressor and coupling the defrost heater to the power supply when a continuous compressor run time exceeds a predetermined demand defrost time. The microprocessor further includes means for determining the time required to actually defrost the evaporator during a defrost operation, referred to herein as a defrost time, and means for modifying the frost accumulation period in response to the time to complete the defrost operation.

The present invention further provides a method for determining the time required to actually defrost the evaporator during a first defrost operation, referred to herein as a first defrost time and for determining the time required to actually defrost the unit during a second defrost operation wherein the second defrost operation is immediately subsequent to the first defrost operation and referred to herein as a second defrost time. An inference is made as to whether the frost accumulating period should be modified before initiating the next defrost operation in response to the first defrost time and the second defrost time and the frost accumulating period is modified if required.

The present invention further includes a fuzzy control which performs fuzzy logic based inference functions on the basis of signals representative of the defrost times as described above such that the optimum frost accumulation period is efficiently achieved. In particular, membership functions according to fuzzy theory are defined for the current defrost time and previous defrost time when defrost is initiated as a result of the cumulative compressor run time reaching a target compressor run time or frost accumulation time. Rules are defined for the linguistic values resultant from mapping the defrost times against the membership functions. Each rule is executed using the fuzzy theory to thereby achieve an optimum frost accumulation time. Further, membership functions according to fuzzy theory are defined for the defrost time when defrost is initiated as a result of an excessively long continuous compressor run time. Rules are defined for the linguistic values resultant from mapping the defrost time against the membership functions. Each rule is executed using the fuzzy theory to thereby achieve an optimum frost accumulation time. These and other features of the invention(s) will become clearer with reference to the following detailed description of the presently preferred embodiments and accompanied drawings.

BRIEF DESCRIPTION OF THE DRAWINGS

FIG. 11 shows a lookup table reflecting output values based on the fuzzy logic illustrated in FIGS. 8–10.

DETAILED DESCRIPTION OF THE PRESENTLY PREFERRED EMBODIMENTS

As discussed above, there is provided a defrost controller including one or more features that, among other things, are particularly useful in increasing the efficiency of a refrigerator/freezer by controlling the defrost cycle and the frost accumulation period.

Figure 1:
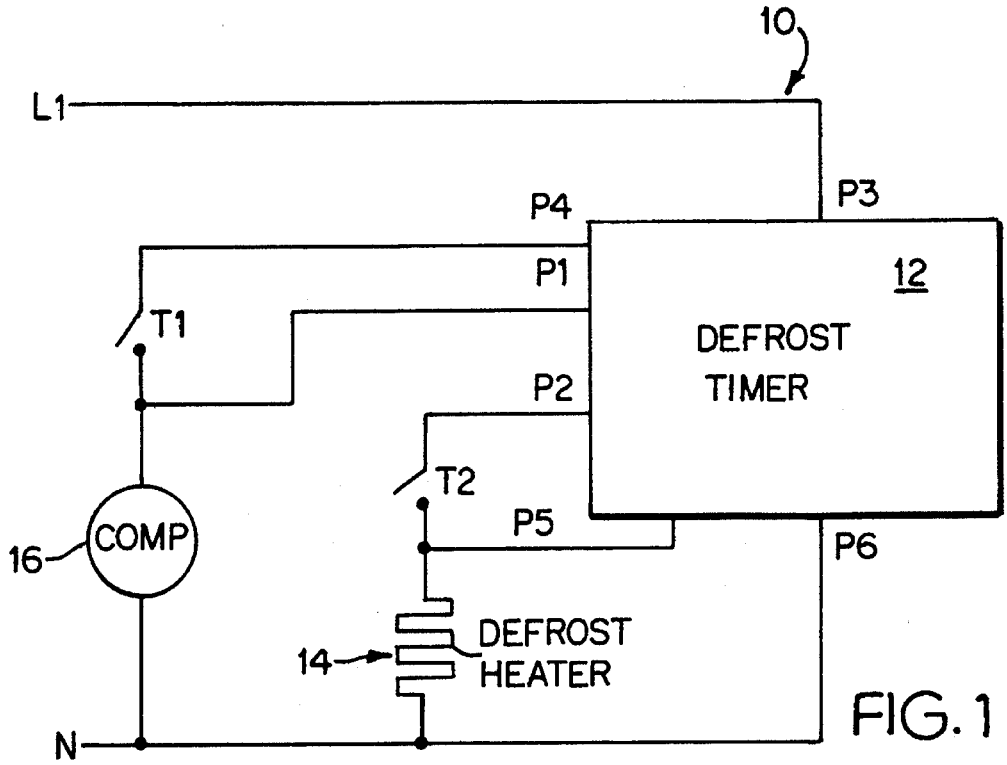
FIG. 1 illustrates a circuit diagram of a generic adaptive defrost controller embodying principles of the invention(s).

In FIG. 1 there is illustrated a defrost cycle controller 10 including a defrost timer module 12 that can embody principles of the invention. As illustrated, coupled between 110 volt alternating current power lines L1 and N is the defrost timer module 12, a defrost heater 14, and a compressor 16. The power line L1 is connected to the defrost timer module via a connection P3 and the power line N is connected to the defrost timer module 12 by means of a connection P6.

The defrost heater 14 is connected between the power line N and the defrost timer module 12 by means of a connection P5. Additionally, the defrost heater 14 is connected to a connection P2 via a bi-metal temperature sensitive switch T2.

Similarly, the compressor 16 is connected between the power line N and a connection P1 of the defrost timer module 12. Additionally, the compressor 16 is connected to a connection P4 of the defrost timer module 12 by means of a thermostat switch T1.

The defrost timer module 12, as will be explained below, preferably includes a microprocessor or application specific integrated circuit (a/k/a ASIC) or microcontroller, with inputs and outputs connected to, among others, the compressor 16 the defrost heater 14, the bi-metal temperature switch T2 and thermostat T1.

As also will be described more fully below, the defrost timer module 12 preferably is provided as a plug-in module that can be connected to the compressor 16 and defrost heater 14 simply by plug-in connections. Thus, all components relating to the defrost timer module 12 would be located in the plug-in module except for the compressor 16, defrost heater 14 and associated thermostat switch T1 and bi-metal switch T2.

Figure 2:
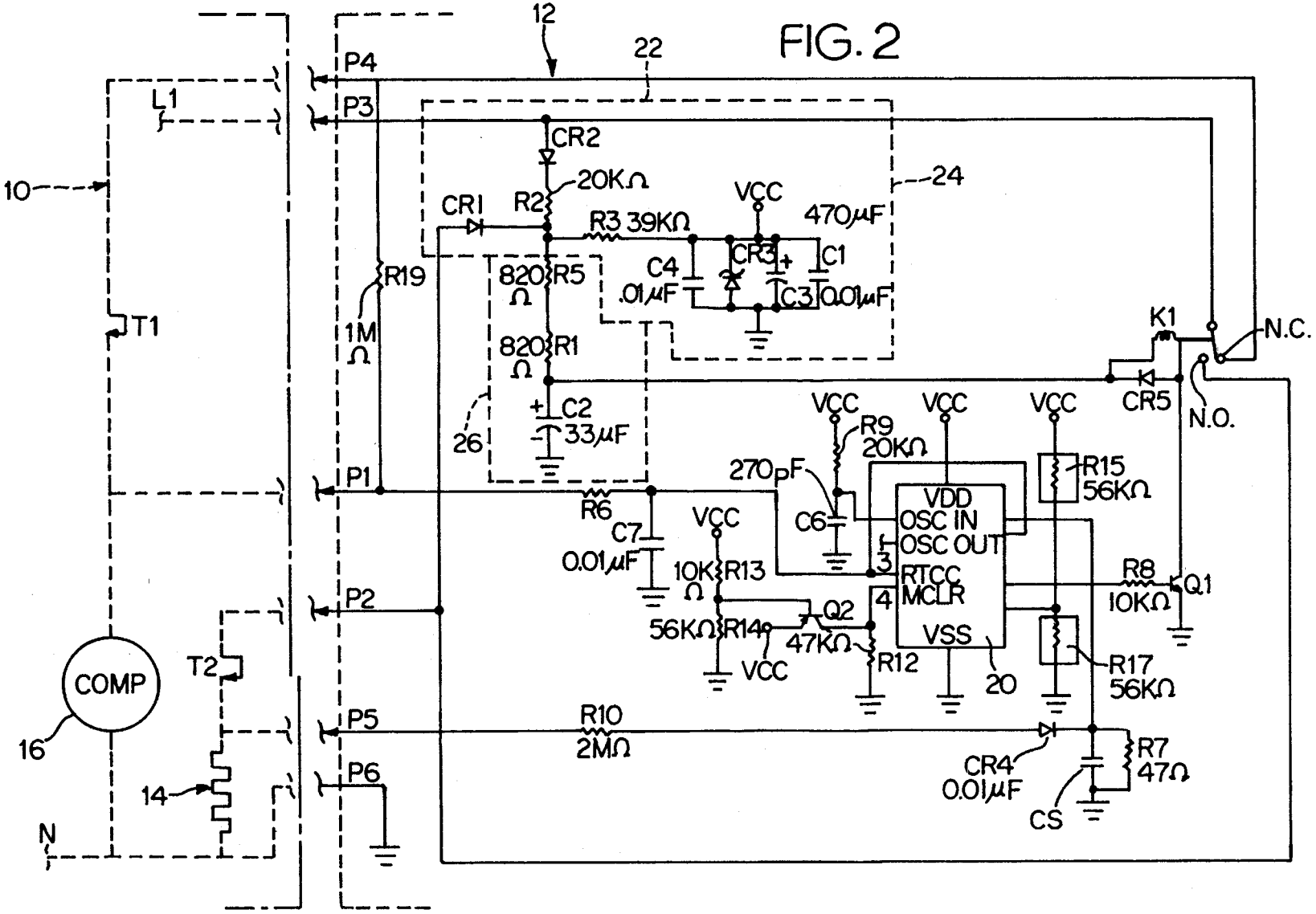
FIG. 2 illustrates a schematic of a defrost controller circuit embodying principles of the invention(s).

In FIG. 2 there is illustrated a schematic of a circuit implementable as the defrost timer module 12. The module 12 is illustrated in position for interconnecting with the defrost heater 14 and compressor 16 via plugs or connectors J1 and J2 formed by the individual connections P1 through P4 and P5 through P6, respectively.

As illustrated, the defrost timer module 12 can comprise a micro-controller or microprocessor or ASIC 20 operatively interconnected with various circuit elements to effect the operation demand for such a module. Preferably, the microprocessor 20 comprises a programmable integrated circuit sold under the designation PIC16C54-RC/P by Microchip Corporation. However, any economical microcontroller with sufficient memory will do.

The embodiment illustrated in FIG. 2, is depicted in a cooling mode for a freezer, i.e. wherein the circuit is not in a defrosting cycle and the compressor 16 is allowed to run. To this end, a control relay K1 is set accordingly with its normally closed contact NC closed so as to supply power from L1 to the compressor 16 via connections P4 and P3 while is normally open contact NO is open to prevent operation of the defrost heater 14.

In operation, the microprocessor 20 senses signals presented to it via connections P1 and P5 which inform the microprocessor 20 about the actual running of the compressor 16 and the actual operation of defrost heater 14. The microprocessor can then determine the cumulative and continuous run times of the compressor and defrost heater on time, thereby to determine how to alter the operation of those devices to obtain maximum efficiency and performance from the system associated therewith.

As is known, the thermostat switch T1 will cycle the compressor 16 on and off during the cooling period to maintain desired temperature. Similarly, the bi-metal switch T2 will turn the defrost heater 14 off upon completion of defrost. In this regard, a defrost interval preferably is set to be about 21 minutes, and the bimetal switch T2 opens at a predetermined temperature to end the heater on time remaining in the drip period. The bimetal switch T2 is not closed until the compressor has been run for a duration sufficient to cool the heater coils to a predetermined degree. However, the microprocessor 20 controls when the compressor 16 and the defrost heater 14 can operate, by switching between cooling and defrost cycles.

In FIG. 2, power from the power line L1 is supplied to connection P3 from which it is then directed to a power supply circuit 22. Connection P4 is connected to the thermostat switch T1 associated with the compressor 16.

Power supply 22 essentially comprises two power supplies: a logic power supply 24 made up of resistor R3, zener diode CR3, and capacitors C1, C3 and C4; and a relay power supply 26 which comprises resistors R1 and R5 and capacitor C2. As illustrated, resistor R2, diode CR2, and diode CR1 are common to both the logic power supply 24 and the relay power supply 26. Resistor R2 is a high impedance resistor having a resistance on the order of 20K ohms while resistors R1 and R5 preferably have resistances of 820 ohms. Resistor R3 is preferably valued at about 39K ohms.

The logic power supply 24 generates an operating voltage VCC approximately equal to 5 volts which enables the microprocessor to start running. Meanwhile, capacitor C2 or relay power supply 26 charges to a value significantly higher than rated voltage. In the presently preferred embodiment, a charge of 55–60 volts was determined to be adequate. Resistors R2, and the impedance from logic power supply act as a voltage divider to limit the voltage on capacitor C2.

The relay power supply 26 provides a low-cost, low-energy usage power supply. This power supply allows the microcontroller 20, which typically requires a 5 volt power supply, to drive the relay K1, which typically requires 12–48 volts, while maintaining low energy consumption.

In the embodiment illustrated in FIG. 2, diode CR2 rectifies the 110 volt alternating current line provided from line L1 thereby to provide rectified current for the 5 volt power supply while maintaining a charge on capacitor C2, while the relay K1 is off. Resistor R2 and the 5 volt side of the power supply circuit 26 create a voltage divider for proper voltage level to the capacitor C2. Diode CR1 rectifies the 110 volt alternating current supply voltage after the relay K1 energizes and provides additional current to the relay K1. The resistors R5 and R1 limit the current through the coil of the relay K1 while it is energized.

When the microprocessor 20 energizes the relay K1 by turning on a transistor Q1 connected thereto, the relay K1 is initially energized by a voltage across the capacitor C2. The defrost heater 14 is connected to the normally open contact NO of the relay 14, as illustrated. Thus, when the microprocessor 20 turns on the transistor Q1 and activates the relay K1, the relay K1 changes state to connect its common terminal with its normally open contact NO, thereby connecting line L1 with connection P2 thereby to energize the defrost heater 14. Connection line P2 is also connected to the power supply intermediate resistors R2 and R5 through rectifier CR1.

Once relay K1 changes state to connect its common terminal with its normally open contact NO, the alternating current line voltage from L1 is fed to the defrost heater 14 via connection P2 and the compressor 16 is disconnected from the line voltage L1. The line voltage is also applied to diode CR1, thereby bypassing the high impedance resistor R2 and energizing relay K1 thereafter through lower impedance resistors R1 and R5.

Because the voltage required to maintain the relay K1 in position is less than the voltage required to effect a change of state in the relay K1, this arrangement is appropriate and utilizes the known property of a relay to advantage. That is, the relay power supply 26 comprising resistors R1 and R5 and capacitor C2 is only engaged and, therefore, only dissipates power when the relay K1 is actuated. The relay power supply 26 provides a voltage that is less than the voltage required to actuate the relay K1.

Thus, the high impedance circuit including resistor R2 is employed during initial activation of the power relay K1, but the current flow through the power relay K1 is used to employ a lesser impedance circuit portion or segment for holding the relay K1 in its closed position.

The microprocessor 20 is provided with two inputs via the connections P1 and P5, as also is illustrated in FIG. 2. Information regarding the compressor 16 is provided via the connection P1 while information about the defrost heater 14 is provided via connection P5.

The compressor 16 is monitored at connection P1 by means of the low pass filter comprising the resistor R6 and the capacitor C7 whenever the compressor is running. As should be apparent, the input will toggle whenever the compressor is running and not toggle whenever it is not running.

However, a possible failure mode for a defrost timing device, based on compressor run time, is to lose the compressor monitoring signal. If the signal is lost, for example due to a broken wire, loose connection, etc., the refrigerator may never be placed in a defrost mode. This could result in food loss, customer dissatisfaction, and a service call.

The generation of a default mode is provided for such a failure. In this regard, the feature provides a default mode in which a lost compressor signal is ignored and the assumption is made that the compressor is operating 100% of the time K1 is not energized. This assumption results in no lost refrigerator performance, except for an increase in energy consumption. This default mode could also be service selectable for a backup mode for worse case conditions, such as extremely high humidity areas.

To this end, voltage at connection P1 must be provided to indicate that the compressor is on. This can be accomplished, as illustrated by providing a pull-up resistor R19 coupled to tie the connection P1 to the line connecting the normally closed contact NC of the relay K1 to the connection P4. If the signal from the compressor is blocked from reaching the microprocessor 20 via connection P2, i.e., connection becomes broken, the pull-up resistor R19 will provide a voltage to the microprocessor 20. If the compressor signal is provided, the impedance of the compressor 16 will cancel out the effects of the resistor R19.

It should be noted that the resistor R19 preferably is provided on the module 12 and thus can be considered internal to the defrost timing module 12, even though in reality, it could be a resistor simply mounted on a circuit board. In any event, the resistor R19 most preferably is connected internally to the module 12, else the signal provided by the resistor R19 could also be lost if the connection P1 is broken.

The microprocessor 20 preferably includes an internal watch dog and an internal power on reset circuitry. There is no need to signal condition the lines that monitor the alternating current signal supply to the compressor 16 and the power supplies 24 and 26 because the microprocessor 20 preferably includes a Schmitt trigger input with a built-in hysteresis on the line connected to the connection P1. Line monitoring of the defrost heater 14 is treated as a direct current (DC) signal by the inclusion of a capacitor C5 which directs all alternating current signals on that line to ground.

In FIG. 2, the microprocessor 20 includes an input labeled "RTCC" which is an acronym for real time clock counter. It can be appreciated that when the compressor 16 is allowed to run, 60 Hz signals will be provided to the microprocessor 20 via connection P1. In this state, the microprocessor 20 can maintain track of real time and react accordingly.

Should the compressor be turned off, however, the 60 Hz timing signal will be lost, for example, during defrost and dripping.

Although initially it was considered necessary to monitor the alternating current at this portion, by providing 60 Hz timing information of the microprocessor 20 during defrosting and dripping, this requirement has been eliminated by performing an internal timing calibration via computer programming of the microprocessor 20. The microprocessor 20 thus detects failure of the relay K1 if 60 Hz information appears while the control circuit is in a defrost or drip mode.

One feature of the invention(s) is a particular way to determine the need for a refrigerator or freezer to defrost based upon the length of time the compressor 16 runs continuously, described herein as the continuous compressor run time CCT. A maximum continuous compressor run time MCCT which would trigger a defrost cycle, referred to as demand defrost time DDT, can be variable based on the cumulative run time CT of the compressor 16.

To this end, the microprocessor 20 can be configured to include an algorithm to monitor when an extended run period after a default compressor run period has been reached. This information can be applied to utilize the algorithm to perform a demand defrost routine.

Essentially, this routine would initiate a defrost cycle when an extended continuous compressor run period CCT is encountered which exceeds the demand defrost time value DDT. The demand defrost time DDT would have no initial target such as for example an initial default target of 10 hours. Instead, demand defrost time value DDT would be set based on the cumulative compressor run time CT. For example, if the cumulative compressor run time CT is 10 hours, then a continuous run time of 2 hours would trigger a defrost. As the cumulative run time increases, the continuous run time that would trigger a defrost cycle, the demand defrost time DDT, would decrease. An example is shown in the following table:

TABLE 1

| Cumulative Compressor Run Time (CT) | Continuous Run Period For Triggering Defrost Cycle (DDT) |
|---|---|
| 0–10 hours | Not Applicable |
| 10–15 hours | 2 hours |
| 15–20 hours | 1.5 hours |
| 20 or more hours | 1 hour |

While this algorithm presents the risk of an increase in the chance that frost will build up on an evaporator coil because the initial cumulative and continuous compressor run periods would be long, it should also be more energy efficient because initially there generally is little frost build-up.

In a modified version of this concept, a cumulative run time of 8 hours will set a continuous run period of 1 hour for triggering a defrost cycle.

It is possible to configure the defrost timer module 12 as a fixed time cumulative run timer by removing or disconnecting the contact P5 by means of which the defrost heater 14 and bimetal switch T2 are monitored. In this regard, generally in order for the timer 12 to perform properly it must receive input signals from the compressor 16 and the defrost heater 14. Monitoring of the signal from the defrost heater provided by a contact P5 informs the microprocessor 20 how long the bi-metal switch T2 took to open once a defrost cycle had been started. This information then is used to predict the next run period of the compressor 16.

If upon entering the defrost mode the microprocessor 20 does not detect that the bi-metal switch T2 is closed and then opened, the length of the defrost period will not be available to calculate the next run period of the compressor 16. The microprocessor 20 will then have to revert back to a default run setting. Therefore, to keep the microprocessor 20 at the default run time period of the compressor 16, the feedback provided via contact P5 from the defrost 12 should be disconnected. This will cause the defrost time module 12 to perform as a fixed time cumulative run timer.

As is known, certain areas of the country are prone to frequent power outages. This can result in a malfunction of certain types of electronic controls. Therefore, many will include a device to maintain the memory of the controller such as a battery or super-capacitor. If the present control system is subjected to a series of outages, a potential frost build-up could occur in the freezer and/or refrigerator associated therewith.

To this end, the sensitivity of the defrost timer 12 to frequent power outages can be reduced by modifying the power up algorithm of the microprocessor. The power up routine can be modified so that if the microprocessor 20 powers up to find the unit is cold and the thermostat switch T1 is open, the microprocessor 20 can perform an initial modified defrost routine. However, if the microprocessor 20 powers up to find a unit with a closed thermostat switch T1, the initial compressor run period will be reduced.

Figure 3:
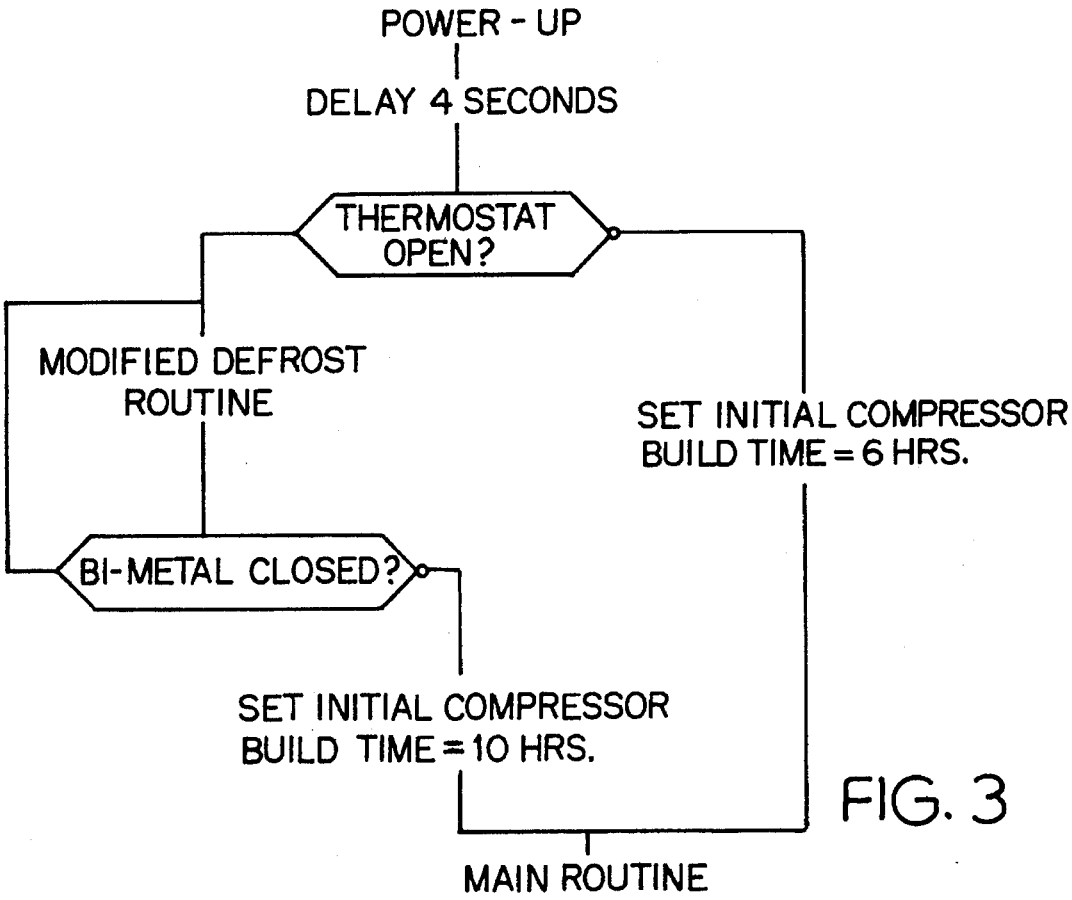
FIG. 3 is a flow chart of an algorithm employed in the circuit of FIG. 2.

As illustrated in FIG. 3, when the controller 20 powers up, it monitors the status of the feedback signals from the refrigerator/freezer at P1 and P5 to determine the status of the unit. If the refrigerator/freezer can be determined to be cold, i.e., the bi-metal T2 is closed, and the thermostat T1 is not calling for cold, i.e. the thermostat T1 is open, then the controller 20 will perform a modified defrost cycle. This modified defrost cycle will not include a drip period as skipping such a drip period will minimize the time until the compressor 16 begins to run. After this modified defrost cycle, the next target compressor build time will be set to a default value, for example such as ten hours.

However, if the unit powers up to see that the unit is calling for cold, i.e., thermostat T1 is closed, then an initial defrost will not occur, thus insuring that when a customer first plugs in the unit, the compressor will run to show that the unit is functioning, but the target compressor build time will be set to a lower value, such as six hours.

The foregoing reduces the time window of a power outage that could disrupt the performance of the controller. The value of this reduce build time is a function of expected frequency of the power outages and the "pull down" performance specification of the refrigerator. If the initial compressor build time is too short, the time to cool a warm refrigerator will be extended because a defrost will occur to soon.

Figures 4, 4A, 4B:
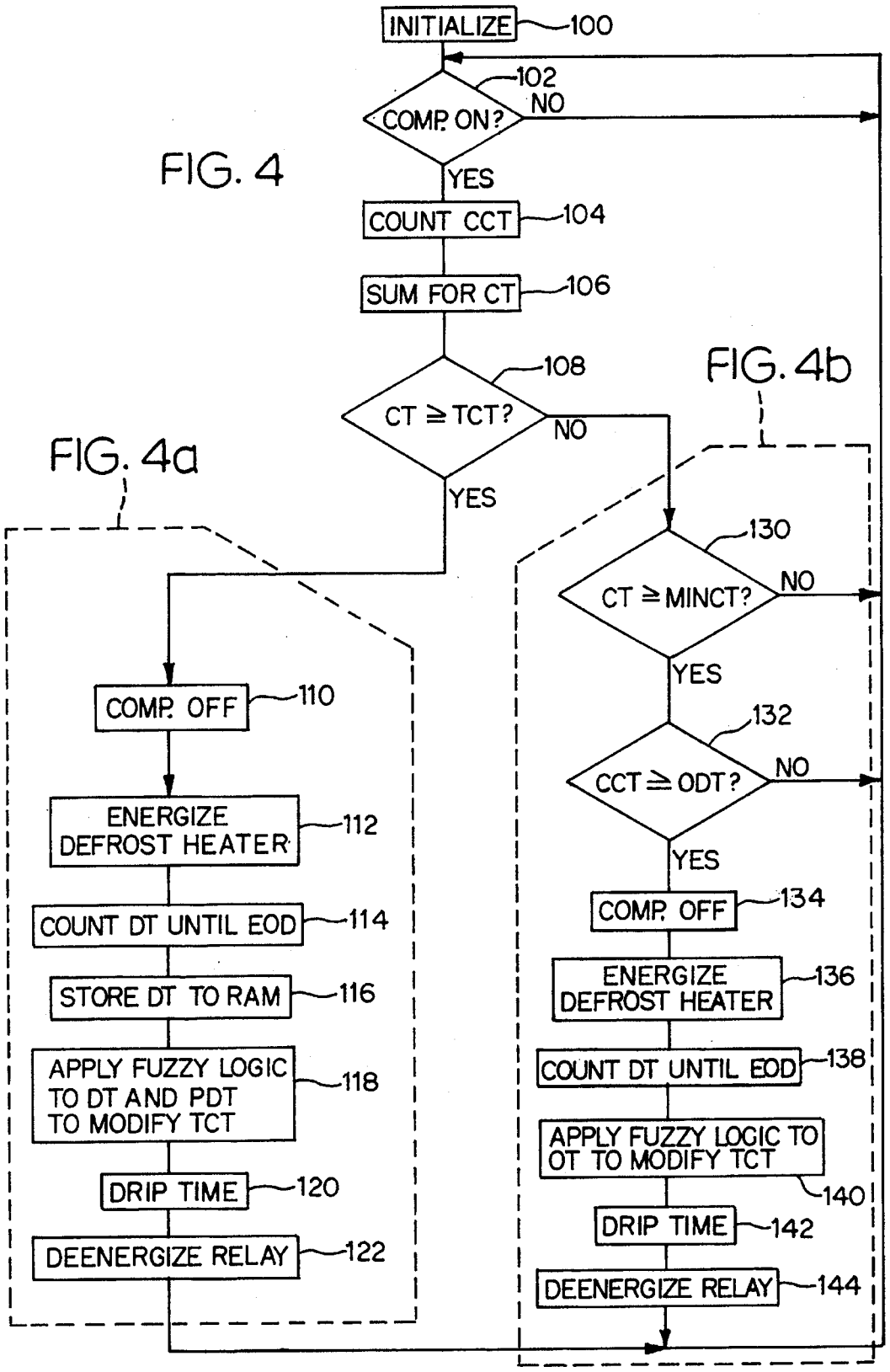
FIG. 4 is a flow chart of another algorithm employed in the circuit of FIG. 2.

In FIG. 4 there is illustrated a flow chart of logic that can be programmed into the microprocessor 20 to effect the normal operation of the defrost timer 12. As illustrated, after the microprocessor 20 has undergone an initialization procedure, for example setting variables, etc., in a first step 100, a determination is made as to whether or not the compressor is on in a step 102. At this juncture, the microprocessor senses whether or not a signal is present at connection P1. If the determination is positive, i.e., the answer is yes, then the continuous compressor run time CCT is counted and accumulated in a step 104. If the answer is no, then the microprocessor remains in a loop, i.e. it returns to step 102, until such time as the compressor is turned on by the switch T1. As illustrated by block 106, simultaneous with the counting of the continuous compressor run time, the present compressor run time is summed with all subsequent compressor run times since the previous defrost period to determine a cumulative compressor run time value CT. In a step 108, the cumulative run time CT of the compressor 16 is compared to a target cumulative compressor run time value TCT which may be able to return to as a frost accumulating period. The target cumulative compressor run time is initialized from ROM to RAM in step 100 and is preferably contemplated to be initialized as 10 hours.

If the cumulative run time CT of the compressor is equal to or greater than the target cumulative compressor run time value TCT, then the microprocessor enters into a defrost mode as indicated in FIG. 4*a*. To initiate the defrost mode, the compressor 16 is de-energized and the defrost heater is energized as shown in steps 110 and 112 respectively. As indicated by block 114, the defrost time DT, which is defined as the time the defrost heater is energized, is counted until an end of the defrost period is reached, as determined by the opening of bi-metal temperature sensitive switch T2. The measured defrost time DT is then stored to RAM, as indicated in block 116. Subsequently, as shown in block 118, the previous measured defrost time PDT and the currently measured defrost time DT are supplied as inputs to a fuzzy logic control system, incorporated in the microprocessor 20 and described herein as a fuzzy logic control 20*a*, for modifying the target compressor run time TCT.

As indicated by block 120, a drip time follows the defrost time during which the melted frost is allowed to drip off the heat exchanger. Thereafter, as indicated by block 122, the relay K1 is de-energized and then the microprocessor returns to step 102.

One feature of the invention(s), therefore, is the control system for optimizing the target compressor run time value TCT and in particular fuzzy logic control 20*a*. The fuzzy logic control 20*a* receives as inputs the current defrost time DT and the previous defrost time PDT and compares these inputs to an optimum defrost time ODT. The timer module 12 defines the optimum defrost time ODT, which is correlated with an optimumization operation of the refrigerator wherein the energy efficiency of the refrigerator operation is optimized. It can be understood that the optimum defrost time varies with, depends upon the size of the defrost heater.

In the preferred embodiment, if the timer defrost module is associated with a refrigerator having a 600 watt defrost heater, the optimum time is 13 minutes, while for a refrigerator having a 400 watt defrost heater, the optimum defrost time is 17 minutes. Generally, measured defrost times DT and PDT that are shorter than the optimum defrost time ODT indicate that only a small amount of frost has accumulated on the evaporator coils. In this case, therefore, the fuzzy control 20*a* would lengthen the subsequent target compressor run time value TCT. In a like manner, defrost times DT and PDT that are longer than the optimum defrost time ODT indicate excessive frost on the evaporator coils and, therefore, the fuzzy logic control 20*a* would decrease the subsequent target compressor run time value TCT.

The fuzzy control 20*a*, therefore , can be understood to receive input values representing the current defrost time DT and the previous defrost time PDT while the output of the fuzzy control 20*a* is a signal representative of a change in the target compressor run time TCT.

The fuzzy control 20*a* executes three fuzzy logic stages: (1) fuzzification, (2) rule application and (3) defuzzification, according to the mathematics of fuzzy theory.

Figures 5, 6:
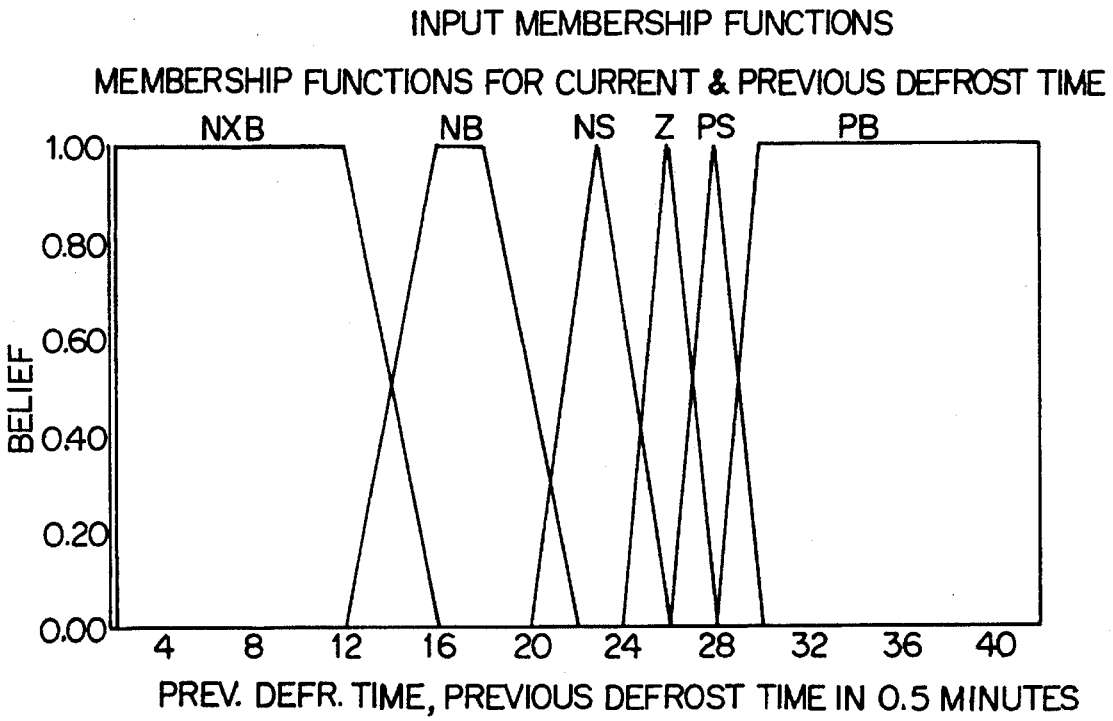
FIG. 5 illustrates the input membership functions for the current defrost time and the previous defrost time.
FIG. 6 illustrates the fuzzy logic rule base for current defrost time linguistic values and the previous defrost times linguistic values as derived from FIG. 5.

In the fuzzification stage, the system inputs, the current defrost time DT and the previous defrost time PDT, are manipulated and mapped to linguistic values or fuzzy inputs through predetermined membership functions. FIG. 5 shows the set of membership functions for the input values of current defrost time DT and the previous defrost time PDT, whereby the same membership functions can be used for both input values. In FIG. 5, the ordinate represents the degree of membership and the abscissa represents the defrost time DT, both current DT and previous PDT, in 0.5 minute increments. The trapezoidally shaped membership functions for NXB (negative extra big), NB (negative big) and PB (positive big) and the triangularly shaped functions NS (negative small), Z (zero) and PS (positive small) map the range of defrost times to degrees of membership in the fuzzy functions based on an experts knowledge of defrost functioning. In this fashion, the defrost operation may be controlled in an optimum fashion in accordance with the expert knowledge as represented in the fuzzy system.

In general, in the rule application stage, logic rules are applied to the set of linguistic values or input membership values resultant from mapping the current defrost time DT and previous defrost time PDT to the input membership functions. From this application of the logic rules, a set of linguistic output values or conclusions are derived. FIG. 6 illustrates the fuzzy logic rule base applied to the input membership values for determining conclusions or fuzzy outputs in the present invention. By use of these fuzzy logic rules, an inference may be made regarding the fuzzy input values. The construction of the fuzzy logic rule base represents an experts knowledge of defrost operation based on the length of the current and previous defrost times.

The rule application stage includes two separate operations: (1) rule evaluation and (2) rule aggregation.

In the rule evaluation operation, the degree to which each rule is fired is controlled using a max-min Inference method. In this manner, the degree of membership of the conclusions or fuzzy output values resultant from the rules fired is equal to the minimum degree of membership for the fuzzy input values.

In the rule aggregation operation, the set of fuzzy output values, representing degrees of membership in the output membership functions, are aggregated. Specifically, for each output membership function, the rule fired with the maximum degree of membership or maximum rule strength controls the degree of membership.

Figure 7:
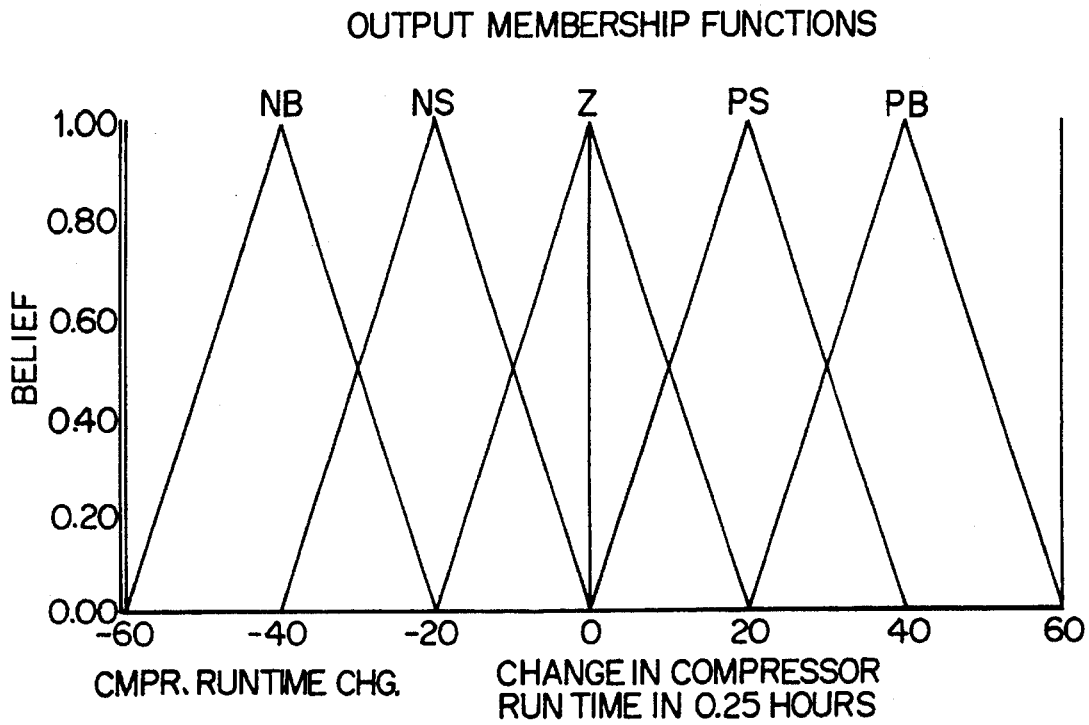
FIG. 7 illustrates the output membership functions for determining the change in the target compressor run time or frost accumulating period based on the output linguistic values from FIG. 6.

In the defuzzification stage, the aggregated fuzzy output values are applied to a set of output membership functions, illustrated in FIG. 7, for determining the output of the fuzzy controller 20*a* for controlling the amount of change in the target compressor run time TCT. In the preferred embodiment, a center of gravity method is used in the defuzzification stage.

Two sample cases are described below to demonstrate the control system.

| | Case 1 |
|---|---|
| Initial Conditions: | |
| Current defrost time DT: | 9 minutes |
| Previous defrost time PDT: | 10.5 minutes |
| Fuzzification: | (See FIG. 5) |
| Current defrost time DT: 1.0 NB | |
| Previous defrost time PDT: 0.3 NB; 0.3 NS | |
| Rule Applications: | (See FIG. 6) |
| Rule evaluation: | If current defrost time is NB and previous defrost time is NB then change in compressor run time is PB (0.3 PB). If current defrost time is NB and previous defrost time is NS then change in compressor run time is (0.3 PB). |
| Rule aggregation: | Linguistic output membership value(s) = 0.3 PB |
| Defuzzification: | (See FIG. 7) |

Since the linguistic output value(s) is 0.3 PB, change in target compressor run time TCT is +11 hours (utilizing the center of gravity method).

In this case, it can be seen that both the current defrost time (9 min.) and the previous defrost time (10.5 min.) are much less than the optimum defrost time (13 min). From this information, it can generally be assumed that only a small amount of frost accumulated on the evaporator coils and the defrost cycle was initiated prematurely. It will be desirable, therefore, to increase the subsequent target compressor run time TCT. Applying the fuzzy control to these inputs results in a change in the target compressor run time of 11 hours.

| Case 2: | |
|---|---|
| Initial Conditions: | |
| Current defrost time DT: | 13.5 min. |
| Previous defrost time PDT: | 14.5 min. |
| Fuzzification: | (See FIG. 5) |
| Current defrost time DT: | 0.5 z, 0.5 PS |
| Previous defrost time PDT: | 0.5 PS, 0.5 PB |
| Rule Applications: | (See FIG. 6) |
| Rule evaluation: | Set of linguistic output values or conclusion: 0.5 Z, 0.5 NS,z 0.5 Z and 0.5 NS |
| Rule aggregation: | Linguistic output values: 0.5 Z and 0.5 NS |
| Defuzzification: | (See FIG. 7) |

Since the linguistic output valued are 0.5 Z and 0.5 NS, change in target compressor run time TCT is =2.5 hours (utilizing the center of gravity method).

In this case, it can be seen that both the current defrost time (13.5 min.) and the previous defrost time (14.5 min.) are greater than the optimum defrost time (13 min). From this information, it can generally be assumed that an excessive amount of frost accumulated on the evaporator coils and the defrost cycle was not initiated soon enough. It will be desirable, therefore, to decrease the subsequent target compressor run time TCT. Applying the fuzzy control to these inputs results in a change in the target compressor run time of −2.5 hours.

Referring now back to FIG. 4, and 4B, if given the cumulative run time CT of the compressor 16 is less than the target cumulative compressor run time TCT, as compared in step 108, the microprocessor determines whether the cumulative run time CT of the compressor has exceeded a minimum cumulative run time MINCT, such as 8 hours, as shown in step 130. The minimum cumulative run time MINCT is initialized to RAM from ROM in block 100. If the cumulative run time CT has not exceeded the minimum cumulative run time MINCT, then the microprocessor loops back to step 102. However, if CT exceeds MINCT, then the microprocessor 20 determines whether the continuous compressor run time CCT is equal to or has exceeded a maximum continuous run time value or demand defrost time DDT as shown in step 132. The demand defrost time value DDT is set from ROM and may preferably be equal to 1 hour. However, the demand defrost time DDT may be variable based on the above described method illustrated in table 1. If the continuous compressor run time CCT has not exceeded the demand defrost time DDT, the microprocessor 20 loops back to step 102. However, if the continuous compressor run time CCT is equal to or exceeds the demand defrost time DDT, then the microprocessor 20 initiates a defrost cycle.

To initiate the defrost mode, the compressor 16 is de-energized and the defrost heater is energized as shown in steps 134 and 136 respectively. As indicated by block 138, the defrost time DT, which is defined as the time the defrost heater is energized, is counted until an end of the defrost period is reached, as determined by the opening of bi-metal temperature sensitive switch T2. Subsequently, as shown in block 140, the currently measured defrost time DT is supplied as an input to a fuzzy logic control system, incorporated in the microprocessor 20 and described herein as a fuzzy logic control **20*b***, for modifying the target compressor run time TCT.

As indicated by block 142, a drip time follows the defrost time during which the melted frost is allowed to drip off the heat exchanger. Thereafter, as indicated by block 144, the relay K1 is de-energized and then the microprocessor returns to step 102.

One feature of the invention(s), therefore, is the control system for optimizing the target compressor run time value TCT and in particular fuzzy logic control **20*b*. The general operation of the fuzzy control 20*b*** may be described as follows.

The fuzzy logic control **20*b* receives as an input the current defrost time DT and compares it to an optimum defrost time ODT. The timer module 12** defines the optimum defrost time ODT, which is correlated with an optimum operation of the refrigerator wherein the energy efficiency of the refrigerator operation is optimized. As described above, it can be understood that the optimum defrost time is related to the size of the defrost heater. In the preferred embodiment, if the timer defrost module is associated with a refrigerator having a 600 watt defrost heater, the optimum time is 13 minutes, while for a refrigerator having a 400 watt defrost heater, the optimum defrost time is 17 minutes.

Several examples are illustrative of the logic used in developing the fuzzy control **20*b***.

1. Generally, if a continuous compressor run time CCT which exceeds the demand defrost time is a result of excessive frost build up on the evaporator coil, the resulting defrost heater on time will be quite long. This signals to the fuzzy control **20*b*** that the refrigerator has not adapted properly to the existing environment and should reset the target compressor run time TCT to the nominal value from ROM.

2. If a continuous compressor run time CCT which exceeds the demand defrost time is a result of a moderate frost build up on the evaporator coil, a long door opening, or a heavy food load addition to the refrigerator, the resulting defrost heater on time may be in the nominal range approximately near the target defrost time. In this case, the control may proceed to the next target compressor run time TCT or build cycle with caution such that the next be target compressor run time will be reduced but not reset to nominal.

3. If a continuous compressor run time CCT which exceeds the demand defrost time occurs but is not a result of a large frost load but is rather the result of a long door opening or a heavy food load addition to the refrigerator, the resulting defrost heater on time may be quite short. This would signal that frost was not a problem and therefore the fuzzy control **20*b* would not reset or reduce the target compressor run time TCT. The control 20*b*** would allow the next target compressor run time TCT to equal the last.

Figure 8:
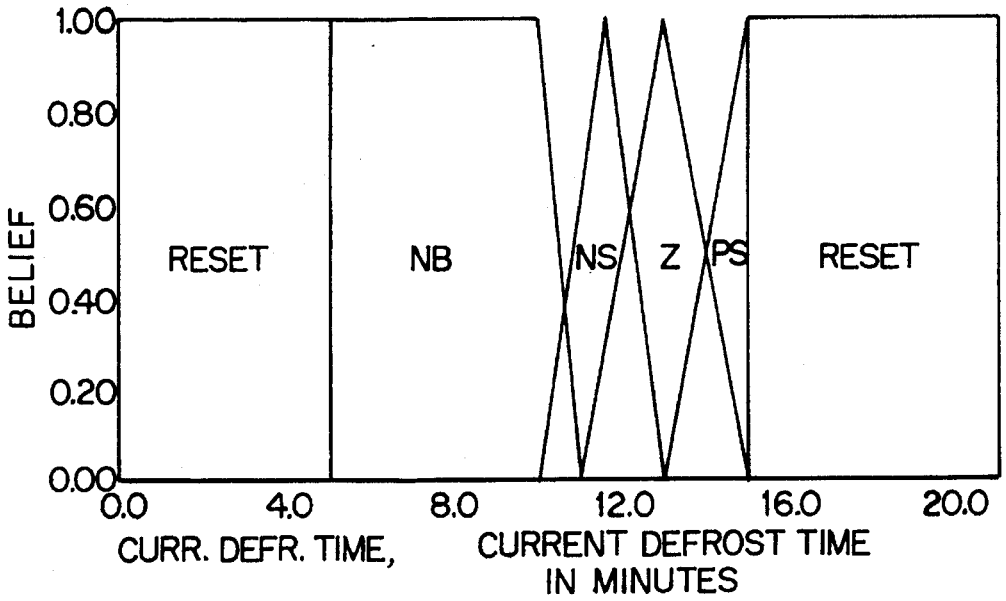
FIG. 8 illustrates the input membership functions for the defrost time when defrost is initiated in response to an excessively long continuous compressor run.
Figures 9, 10:
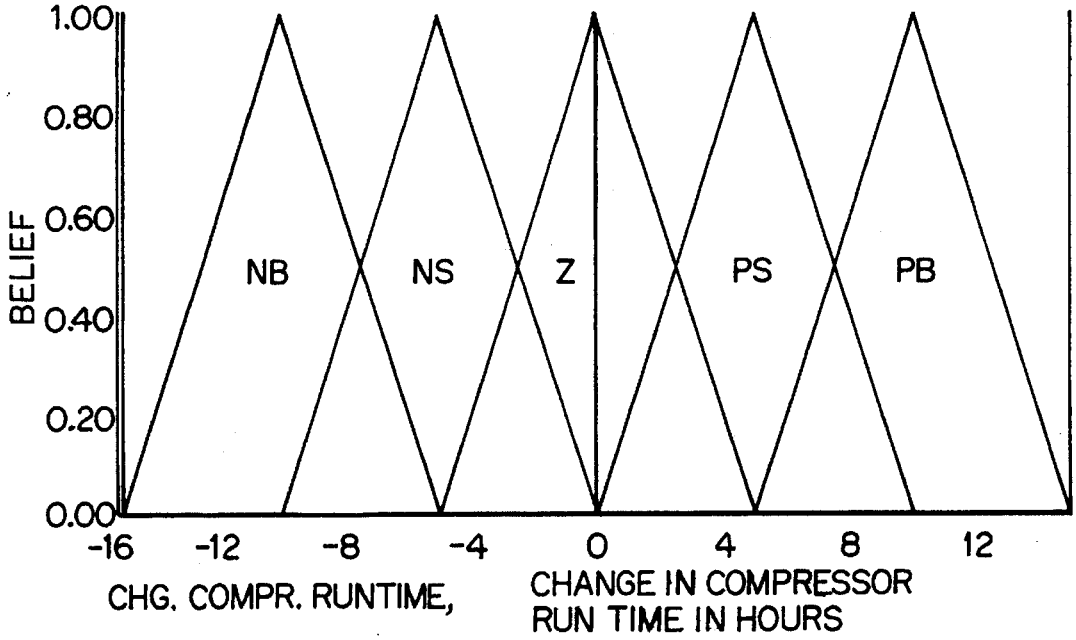
FIG. 9 illustrates the fuzzy logic rule base for the defrost time input linguistic values as derived from FIG. 8.
FIG. 10 illustrates the output membership functions for determining the change in the target compressor run time or frost accumulating period based on the output linguistic values from FIG. 9.

The fuzzy control **20*b* executes three fuzzy logic stages: fuzzification, rule application and defuzzification, according to the fuzzy theory. In the fuzzification stage, the system input, the current defrost time DT, is manipulated and mapped to linguistic values or through fuzzy inputs, a set of predetermined membership functions. FIG. 8 shows the membership functions for the input value of current defrost time DT. In FIG. 8, the ordinate represents the degree of membership and the abscissa represents the defrost time DT, in 0.5 minute increments. The trapezoidally shaped membership functions for RESETS (reset small), NB (negative big) and RESETB (reset big) and the triangularly shaped functions NS (negative small), Z (zero) and PS (positive small) map the range of defrost times to the degree of membership in the fuzzy functions based on an experts knowledge of defrost functioning. In this fashion, the defrost operation may be controlled in an optimum fashion in accordance with the expert knowledge as represented in the fuzzy system. In the rule application stage, logic rules are applied to the set of linguistic values or fuzzy inputs values resultant from mapping the current defrost time DT to the input membership functions. From this application of the logic rules, a set of linguistic output values or conclusions are derived. FIG. 9** illustrates the fuzzy logic rule base applied to the input membership values for determining conclusions of fuzzy outputs in the present invention. By use of these fuzzy logic rules, an inference may be made regarding the fuzzy inputs. The construction of the input membership functions, the fuzzy logic rule base represents an experts knowledge of defrost operation based on the length of the current and previous defrost times.

The rule application stage includes two separate operations: rule evaluation and rule aggregation. In the rule evaluation operation, the degree to which each rule is fired is controlled using a min-max Inference method. In this manner, the degree of membership of the conclusions or fuzzy output values resultant from the rules fired is equal to the minimum degree of membership for the fuzzy input values. In the rule aggregation operation, the set of output values, representing degrees of membership in the output membership functions, are aggregated. Specifically, for each output membership function, the rule fired with the maximum degree of membership or maximum rule strength controls the degree of membership.

In the defuzzification stage, the aggregated fuzzy output values are applied to an output membership function, illustrated in FIG. 10, for determining the fuzzy controller **20*b*** output for controlling the amount of change in the target compressor run time TCT. Specifically, a center of gravity method is used in the defuzzification stage.

A sample case is described herein below to demonstrate the control system implemented in the fuzzy logic **20*b***.

| Case 3: | |
|---|---|
| Initial Conditions: | |
| Target compressor run time TCT: | 18 hours |
| Cumulative compressor run time CT: | 16 hours |
| Min. cumulative comp. run time MINCT: | 10 hours |
| Cumulative compressor run time CCT: | >1 hour |
| Demand defrost time DDT: | 1 hour |
| Defrost time DT: | 14.2 min. |
| Fuzzification: | (See FIG. 8) |
| Defrost time DT: | 0.2 Z, 0.8 PS |
| Rule Application: | (See FIG. 9) |
| Rule Evaluation: | Set of linguistic output values or conclusion: 0.2 NS and 0.8 NB. |
| Rule Aggregation: | Linguistic output values: 0.2 NS and 0.8 NB |
| Defuzzification: | (See FIG. 10) |

Since the linguistic output values are 0.2 NS and 0.8 NB, change in target compressor run time TCT is −9 hours (utilizing the center of gravity method).

The logic behind the fuzzy control **20*b* can simplified and be reduced to a look-up table, as shown in FIG. 11. FIG. 11 shows a look-up table for a refrigerator having a 13 min defrost target (600 watt defrost heater) or a 17 min defrost target (400 watt defrost heater). It can be understood, therefore, that the implementation of the fuzzy control 20*b* may be achieved by encoding the look-up table of FIG. 11 into the controller 20**.

In this fashion therefore, a novel adaptive defrost system for determining the frost build period or the target compressor run time for a refrigerator is provided. More specifically, a fuzzy control system utilizing the inputs of the defrost length and the previous defrost length is provided for determining the optimum frost built period. Further, a control system responsive to excessive continuous run times for the compressor is provide wherein the frost build period is modified in response to the defrost time.

Although the present invention has been described with reference to a specific embodiment, those of skill in the Art will recognize that changes may be made thereto without departing from the scope and spirit of the invention as set forth in the appended claims.

We claim:

1. A method of controlling the defrosting of a heat transfer unit of a temperature conditioning system by initiating a defrost operation when a predetermined amount of frost has accumulated on the unit during a frost accumulating period that occurs between defrost operations, a known desired defrost time period being required to defrost said unit when it has the predetermined amount of accumulated frost thereon, said method comprising the steps:

(a) measuring the time required to actually defrost said unit during a first defrost operation, referred to herein as a first defrost time;

(b) measuring the time required to actually defrost said unit during a second defrost operation, said second defrost operation being the next defrost operation following the first defrost time, and referred to herein as a second defrost time; and (c) modifying said frost accumulating period in response to said first defrost time and said second defrost time.

2. The method of controlling the defrosting of a heat transfer unit according to claim 1, further comprising the steps of:

mapping said first defrost time to linguistic values in accordance with predetermined input membership functions to obtain a set of first defrost time linguistic input values;

mapping said second defrost time to linguistic values in accordance with predetermined input membership functions to obtain a set of second defrost time linguistic input values;

applying predetermined logic rules to said first defrost time linguistic input values and said second time defrost linguistic input values to derive values for an output set; and applying said output set values to predetermined output membership functions for determining a modification for said frost accumulation period.

3. The method of controlling the defrosting of a heat transfer unit according to claim 1, further comprising the steps of:

increasing said frost accumulating period before initiating the next defrost operation if the first defrost time and the second defrost time are less than said desired defrost time period; and decreasing the frost accumulating period before initiating the next defrost operation if the first defrost time and the second defrost time are more than said desired defrost time period.

4. The method of controlling the defrosting of a heat transfer unit according to claim 1, wherein a predetermined default frost accumulating period is known, further comprising the steps of:

decreasing said frost accumulating period if said first defrost time and said second defrost time are much greater than said desired defrost time;

decreasing said frost accumulating period if said first defrost time is much less than said desired defrost time and said second defrost time is much greater than said desired defrost time; and setting said frost accumulating period equal to said default frost accumulating period if said first defrost time and said second defrost time are much less than said desired defrost time.

5. A method of controlling the defrosting of an evaporator in a refrigeration system, said system including a compressor and a defrost heater associated with the evaporator, a predetermined demand defrost time being known for limiting continuous compressor run times, the method comprising the steps of:

(a) initiating a defrost operation when a continuous compressor run time exceeds said predetermined demand defrost time;

(b) measuring the time required to actually defrost said evaporator during a defrost operation; and (c) modifying a frost accumulation period in response to said defrost time measured in step (b).

6. The method of controlling the defrosting of an evaporator in a refrigeration system according to claim 5, further comprising the steps of:

mapping said defrost time to linguistic values in accordance with predetermined input membership functions to obtain a set of defrost time linguistic input values;

applying predetermined logic rules to said defrost time linguistic input values to derive values for an output set; and applying said output set values to predetermined output membership functions for determining a modification to said frost accumulation period.

7. The method of controlling the defrosting of an evaporator in a refrigeration system according to claim 5, further comprising the steps of:

measuring a cumulative compressor run time occurring between defrost operations; and varying the value of said predetermined demand defrost time in response to said cumulative compressor run times.

8. A defrost cycle controller for a refrigeration system, said system including a compressor, an evaporator and a defrost heater associated with the evaporator, said defrost cycle controller modifying the total length of time the compressor operates before a defrost cycle is initiated, wherein the cumulative time the compressor is energized between defrost cycles is referred to herein as a frost accumulation period, said defrost cycle controller comprising:

a relay operatively connected to mutually exclusively couple said compressor and said defrost heater to a power supply;

a first signal line providing a first signal indicative of the operating status of said compressor;

a second signal line providing a second signal indicative of the operating status of said defrost heater; and a microprocessor operatively coupled to said first and second signal lines and to said delay to control energization of said relay and to selectively couple said compressor and said defrost heater to said power supply, said microprocessor including:

means generating a signal for operating said relay for deenergizing said compressor and coupling said defrost heater to the power supply when a continuous compressor run time exceeds a predetermined demand defrost time, means for measuring the time required to actually defrost said evaporator during a defrost operation, and means for modifying said frost accumulation period in response to said time to actually defrost said evaporator during said defrost operation.

9. The defrost cycle controller for a refrigeration system according to claim 8, further comprising:

means for mapping said defrost time to linguistic values in accordance with predetermined input membership functions to obtain a set of defrost time linguistic input values;

means for applying predetermined logic rules to said defrost time linguistic input values to derive values for an output set; and means for applying said output set values to predetermined output membership functions for determining a modification to said frost accumulation period.

10. The defrost cycle controller for a refrigeration system according to claim 8, further comprising:

means for measuring a cumulative compressor run time occurring between defrost operations; and means for varying the value of said predetermined demand defrost time in response to said cumulative compressor run times.

11. The defrost cycle controller for a refrigeration system according to claim 8, further comprising:

means for measuring the time required to actually defrost said unit during a first defrost operation, referred to herein as a first defrost time;

means for measuring the time required to actually defrost said unit during a second defrost operation, said second defrost operation being immediately subsequent to said first defrost operation and referred to herein as a second defrost time; and means for modifying said frost accumulating period in response to said first defrost time and said second defrost time.

12. The defrost cycle controller according to claim 9, wherein the continuous compressor run times and the cumulative compressor run times are correlated as follows:

| Cumulative Compressor Run Time | Continuous Compressor Run Time Which Will Trigger Coupling of Defrost Heater to Power Supply |
|---|---|
| From 10 to less than 15 hours | 2 hours |
| From 15 to less than 20 hours | 1.5 hours |
| 20 or more hours | 1 hour |

* * * * *